United States Patent [19]

Stiver et al.

[11] Patent Number: 5,056,351

[45] **Date of Patent: * Oct. 15, 1991**

[54] CRIMPING DEVICE AND ADJUSTING RING

[75] Inventors: C. Edward Stiver; George J. Teti, both of Ocala, Fla.; Charles S. Pearson, Waynesville, N.C.; Kenneth R. Brown, Silver Springs, Fla.

[73] Assignee: Dayco Products, Inc., Dayton, Ohio

[ * ] Notice: The portion of the term of this patent subsequent to Sep. 5, 2006 has been disclaimed.

[21] Appl. No.: 530,371

[22] Filed: May 30, 1990

Related U.S. Application Data

[62] Division of Ser. No. 366,083, Jun. 14, 1989, Pat. No. 4,953,383, which is a division of Ser. No. 150,263, Jan. 26, 1988, Pat. No. 4,862,725.

[51] Int. Cl.[5] ..... B21D 41/04; B21D 39/04

[52] U.S. Cl. ..... 72/402; 72/446; 72/35; 100/257; 29/237

[58] Field of Search ..... 72/402, 453.01, 453.02, 72/453.03, 453.04, 453.15, 453.18, 446, 35, 36; 29/237; 100/99, 257

[56] References Cited

U.S. PATENT DOCUMENTS

| | | | |
|---|---|---|---|
| 2,082,364 | 6/1937 | Store | 100/99 |
| 2,426,446 | 8/1947 | Funk . | |
| 3,154,978 | 11/1964 | Baker . | |
| 3,335,594 | 8/1967 | Peterman . | |
| 3,568,494 | 3/1971 | Geisman . | |
| 3,822,456 | 7/1974 | Petruzzi | 72/402 |
| 4,107,964 | 8/1978 | Smith | 72/402 |
| 4,118,970 | 10/1978 | Patel | 72/402 |
| 4,244,091 | 1/1981 | Kimble | 72/402 |
| 4,285,228 | 8/1981 | Gunning | 72/402 |
| 4,331,019 | 5/1982 | Smith | 72/402 |
| 4,625,539 | 12/1986 | Brooks | 72/402 |
| 4,831,864 | 5/1989 | Schmou | 72/446 |

*Primary Examiner*—Daniel C. Crane
*Attorney, Agent, or Firm*—Joseph V. Tassone

[57] ABSTRACT

A device is provided for crimping a coupling on the end of a hose. The device has a die assembly for holding the hose and coupling spaced apart from and in axial alignment with a crimping mechanism comprised of a hydraulic cylinder and a pusher. The cylinder has an internal stop. A fluid operated actuator mechanism moves the crimping mechanism axially downward to engage the die assembly. The device has an adjusting mechanism for adjusting the crimping mechanism in a predetermined relationship to the die assembly. The crimping mechanism and the adjusting mechanism cooperate so that when the crimping mechanism engages the internal stop, the coupling is crimped to the hose end in accordance with the predetermined relationship. The adjusting mechanism contains an angular scale and a linear scale both with marked divisions. The adjusting mechanism provides for easy recalibration of the device.

14 Claims, 5 Drawing Sheets

CRIMPING DEVICE AND ADJUSTING RING

CROSS REFERENCE TO RELATED APPLICATIONS:

This application is a divisional patent application of its copending parent patent application, Ser. No. 366,083, filed June 14, 1989, now U.S. Pat. No. 4,953,383, which, in turn, is a divisional patent application of its copending parent patent application, Ser. No. 150,263, filed Jan. 29, 1988, now U.S. Pat. No. 4,862,725.

BACKGROUND OF THE INVENTION

1. Field of the Invention

The present invention relates to a device for crimping a workpiece, such as a coupling on a hose, an adjusting and presetting mechanism comprising the device and a method for the use thereof.

2. Prior Art Statement

Crimping machines, together with associated crimping dies and pusher assemblies, are used in those applications where an evenly distributed, circumferentially applied force is needed to reduce the diameter of a workpiece without radial distortion. In order to provide an evenly distributed, circumferentially applied force, crimping machines conventionally employ crimping dies comprising a plurality of die fingers which are disposed around the workpiece, and have a curved inside surface adjacent the workpiece which substantially matches the curvature of the workpiece. A ram and driving means are provided to apply a pressing force to the crimping die through a pusher assembly, the pusher assembly being provided to control the amount of the crimp and to assure that the pressing forces of the ram are applied evenly to the die assembly. Means are provided for transferring the linear forces of the ram into radially applied forces on each of the die fingers, causing the die fingers to move uniformly to reduce the diameter of the die fingers such that the die fingers each contact the workpiece with substantially equal force.

Because of the large variety of sizes and types of work pieces that require crimping, prior art crimping devices require a large number of crimping dies, a variety of pusher assemblies, and means by which the operator controls the pressure applied to the workpiece in the crimping operation or means by which the operator optically determines the end of the crimping operation.

Geisman, in U.S. Pat. No. 3,568,494 teaches a portable crimping apparatus having radially disposed crimping jaws and a crimping ring having an internal conical shape for moving said crimping jaws radially inward, said ring having an internal thread disposed on the inside of said crimping ring. Geisman additionally shows and describes a scale, a pin and a knurled knob affixed to the top of a sleeve which surrounds the pin all used to indicate the completion of the crimping stroke.

Kimble et al, in U.S. Pat. No. 4,244,091, teach a hose crimping apparatus which uses radially directed crimping dies, an associated cam surface, and a ram for moving the dies relative to the cam surface in an upward stroke. The apparatus has an associated locator mounted adjacent an outer platform for indicating a relative position to manually stop the crimping device from further operation.

Peterman, et al, in U.S. Pat. No. 3,335,594 teach a crimping apparatus which has a plurality of crimping dies and a gauge to indicate the maximum travel of associated forcing means.

Smith, in U.S. Pat. No. 4,107,964, teaches a crimping device having an adjustable screw threaded member for adjusting the die and an associated indicating means.

Brooks, et al, in U.S. Pat. No. 4,625,539 teaches a crimping device which has means for presetting the stop position of the crimping device, however such a device is not portable.

SUMMARY OF THE INVENTION

In accordance with the present invention there is provided a new device for crimping a workpiece, for instance, a coupling to an end of a hose wherein the device comprises a die means for holding the hose end and the coupling, crimping means spaced apart from die means and in axial alignment therewith and including stop means and moving means for moving the crimping means toward and into engagement with the die means.

In accordance with one embodiment of the invention such new device comprises an adjusting means for adjusting the crimping means in predetermined relationship to the die means with the moving means and adjusting means cooperating such that when the crimping means is moved into engagement with the stop means by the moving means the coupling is crimped to the hose end in accordance with the predetermined relationship.

The invention also provides such adjusting means in the form of an adjusting mechanism comprising an adjusting ring which also provides mounting for the driving means, a holding ring for securing the driving means to the adjusting ring, a calibration ring detachably mounted on the adjusting ring, a scale disposed on the calibrating ring and a removable handle utilized to cause movement to the adjusting mechanism.

The present invention also provides a calibrating mechanism to allow for wear and distortion of the die means, pusher assembly and driving means. The calibration means comprises the adjusting mechanism previously described and a second scale mounted on a calibrating block, an index means adjustably mounted to the device and a locking nut for securing the index.

In an alternative embodiment, the invention also provides for a calibrating ring comprising a plurality of alternating teeth and grooves disposed on the inner surface of the ring, and corresponding teeth and grooves disposed on the outside surface of the adjusting ring providing means of precise calibration of the device.

In an another alternative embodiment, the invention also provides for a calibrating ring comprising a tapered inner surface of the ring, and corresponding tapered outside surface of the adjusting ring providing a means of precise calibration of the device.

The invention also provides a method of using the crimping device and the die assembly which comprises the steps of inserting a workpiece into the crimping device, setting the adjusting mechanism to a preselected position which sets the pusher assembly and the die assembly at a predetermined relationship, driving the ram downward to contact the die assembly until the full stroke of the driving means is reached thereby crimping the workpiece in accordance with the predetermined relationship.

Therefore, it is an object of this invention to provide a new crimping device of the character mentioned.

Another object of this invention is to provide a new method of using a crimping device of the character mentioned.

Other objects, uses and advantages of this invention are apparent from a reading of this description which proceeds with reference to the accompanying drawings forming a part thereof and wherein:

DESCRIPTION OF PREFERRED EMBODIMENT

Figure 1:
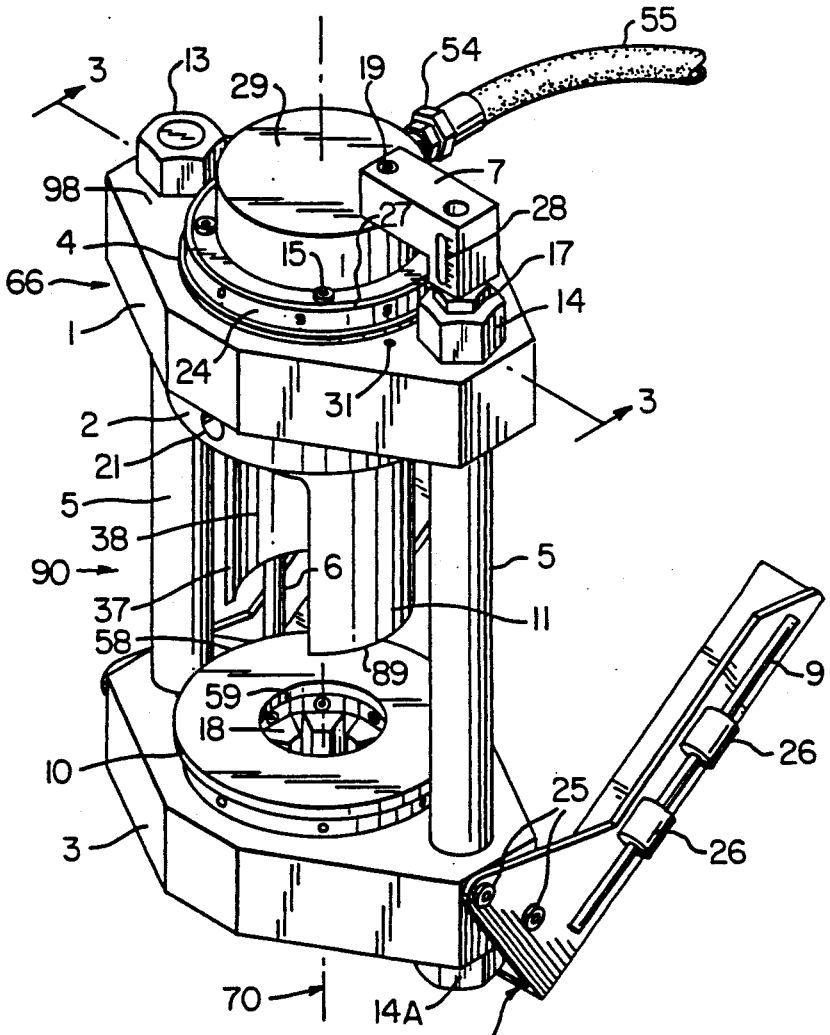
FIG. 1 is an isometric view of the crimper of the present invention.

While the various features of this invention are hereinafter illustrated and described as being particularly adapted to provide a device for crimping a coupling on the end of a hose, it is to be understood that the various features of this invention can be utilized singly or in various combinations thereof to provide a device for other purposes as desired.

Therefore, this invention is not to be limited to only the embodiment illustrated in the drawings, because the drawings are merely utilized to illustrate one of the wide variety of uses of this invention.

Figure 9:
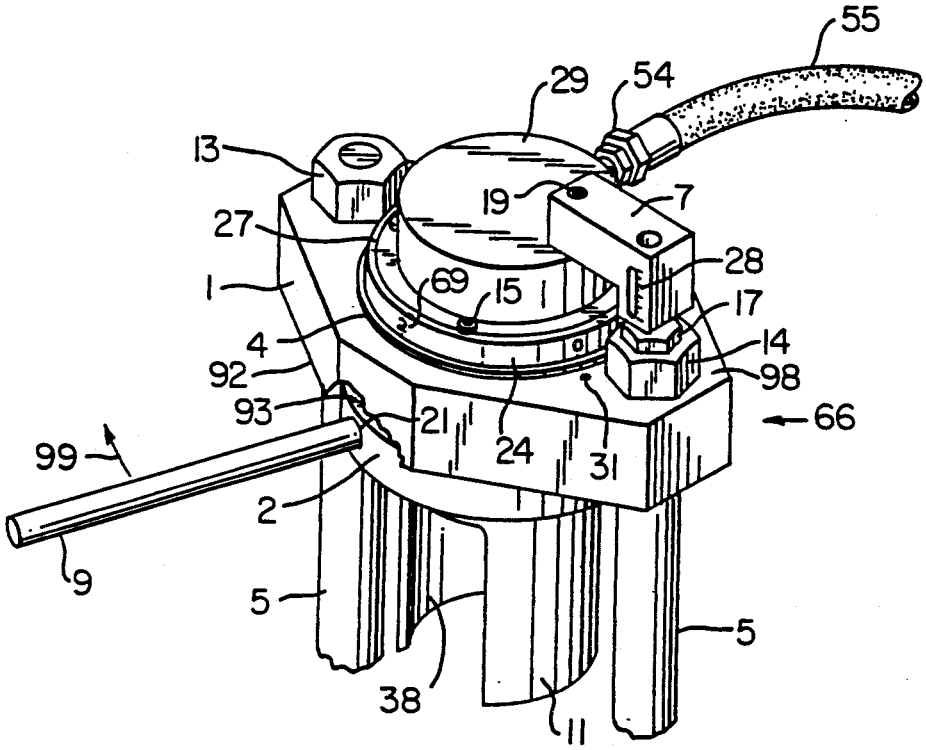
FIG. 9 is a partial isometric view of the top of the crimper of FIG. 1 showing adjusting ring and adjusting handle.
Figure 10:
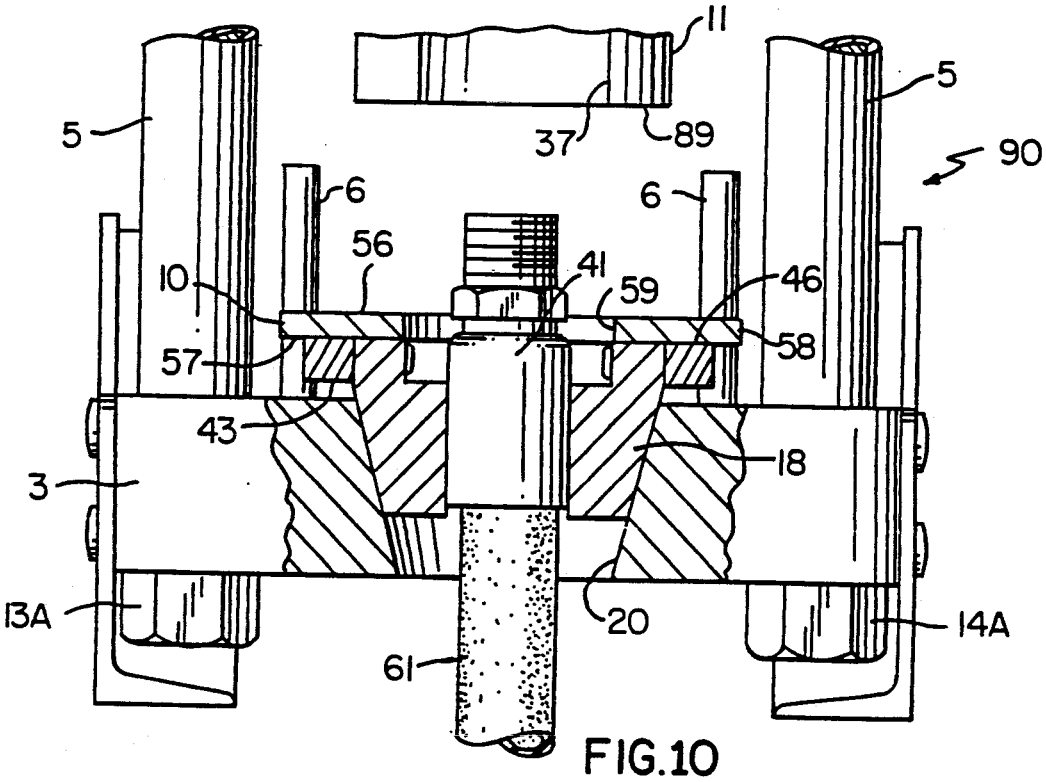
FIG. 10 is a cutaway view of the die assembly of the crimper of FIG. 1 showing an uncrimped workpiece disposed in the crimper prior to crimping.
Figure 11:
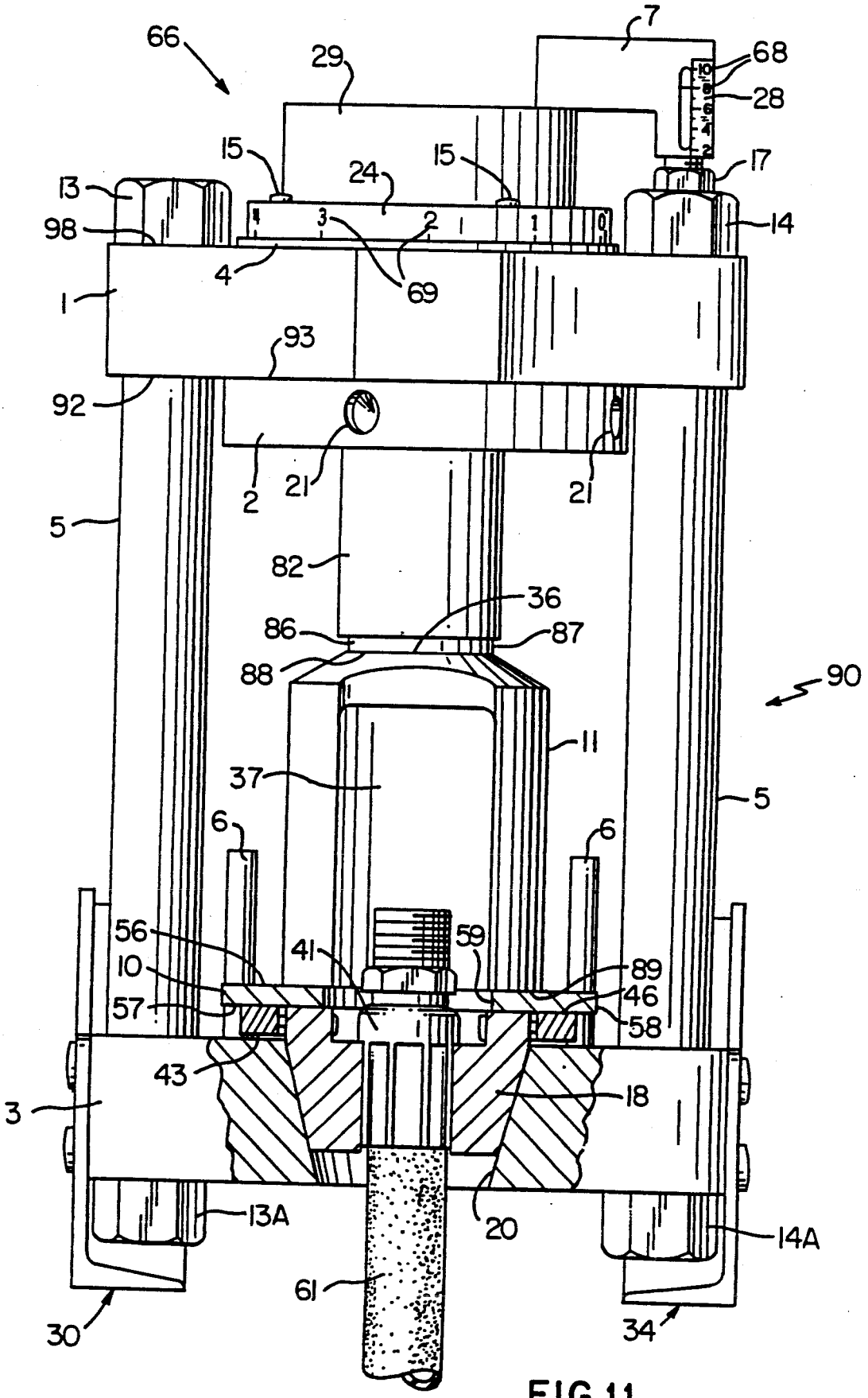
FIG. 11 is a frontal view of the crimper of FIG. 1 with a workpiece disposed in the die assembly and in a fully crimped manner.

Reference is now made to FIG. 10 and FIG. 11 of the drawings which illustrate one exemplary embodiment of a crimping device or apparatus of this invention which is generally designated by reference numeral 90. Device 90 comprises a die assembly 18 for holding a hose end 61 and a coupling 41, crimping means 66 (see FIG. 9) comprising a fluid cylinder 29 and a pusher 11 initially spaced apart from said die assembly 18 and in axial alignment therewith and including stop means 63 and moving means (not shown) for moving said crimping means 66 toward and into engagement with said die assembly 18, the improvement comprising adjusting ring 2 for adjusting said crimping means 66 in predetermined relationship to said die assembly 18, said moving means and adjusting ring 2 cooperating such that when said crimping means 66 is moved into engagement with said stop means 63 by said moving means said coupling 41 is crimped to said hose end 61 in accordance with said predetermined relationship.

Figure 4:
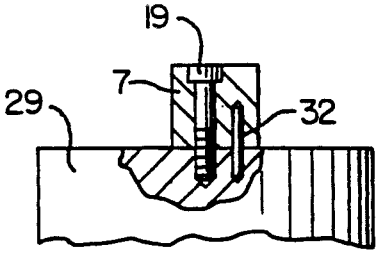
FIG. 4 is a view in partial cross section of the attachment for an indicating and block means of the crimper of the present invention.
Figure 3:
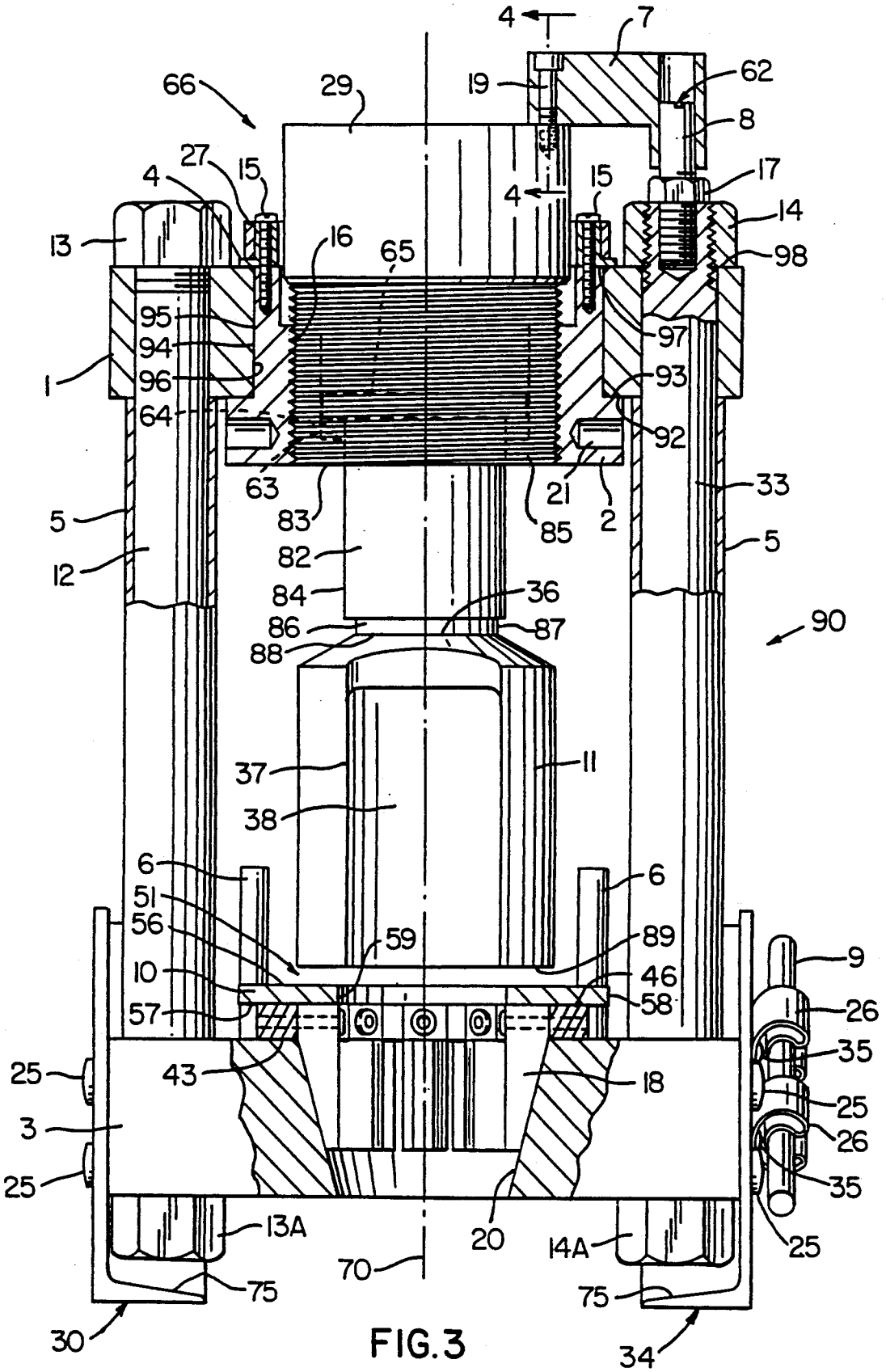
FIG. 3 is frontal view of the crimper of this invention with parts in cross section.

Referring now to FIG. 1 and FIG. 3, device 90 has base plate 3 disposed such that support legs 30 and 34 provide an angular slant to device 90 when said support legs 30 and 34 lie upon a flat surface such as a table. When placed upon a table, ends 75 of support legs 30 and 34 are placed at the edge of the table such that axis 70 of device 90 overlies the edge of the table for easy access thereto. Support legs 30 and 34 are attached to base plate 3 by round head screws 25. Support leg 34 has spring clips 26 attached to the outer surface thereof by screws 35. Detachably disposed within spring clips 26 is adjusting handle 9. Base plate 3 is disposed in spaced relationship from upper retaining plate 1 by sleeves 5 disposed about strain rods 33 and 12. Base plate 3 and upper retaining plate 1 are affixed in the aforementioned spaced relationship with nuts 14, 14A at opposite ends of strain rod 33 and nuts 13 and 13A at opposite ends of strain rod 12. Atop nut 14 lies calibrating screw 8 slidably disposed within block 7 and secured to nut 14 and strain rod 33 by lock nut 17. Block 7 is attached to crimping means 66 by block holding screw 19 and locating pin 32 (as seen in FIG. 4). Locating pin 32 and block holding screw 19 cooperate with calibrating screw 8 to prevent rotation of crimping means 66 during adjusting steps described below.

Figure 5:
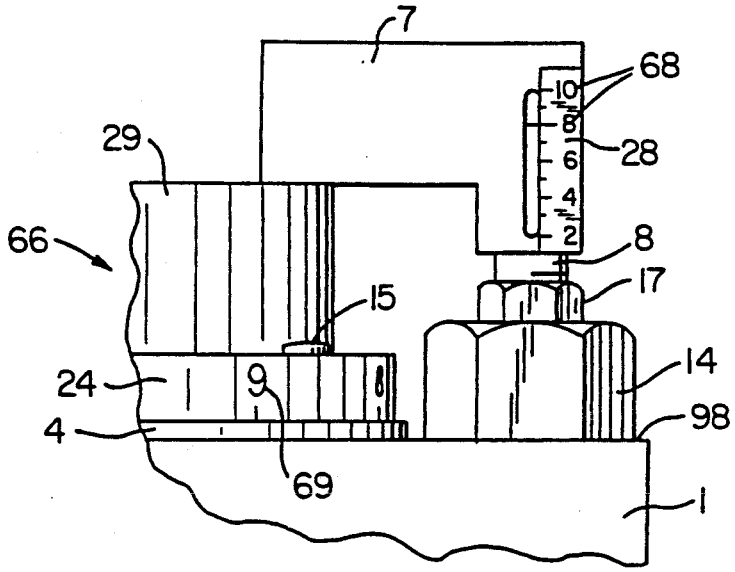
FIG. 5 is a partial cross-sectional view of the upper portion of the crimper of FIG. 1 showing a block means and an annular ring means.

Disposed on the front surface of block 7 is scale 28 having regularly spaced indicia 68 (see FIG. 5). Adjusting ring 2 is disposed into aperture 94 of upper retaining plate 1 and shoulder 93 abuts bottom surface 92 of upper retaining plate 1. Aperture 94 has internal annular surface 96 which provides a free running fit to external annular surface 95 of adjusting ring 2. Cylinder holder plate 4 is disposed about cylinder 29 and is secured to adjusting ring 2 by cylinder holder plate locking screws 15. Cylinder holder plate 4 has annular flat surface 97 overlying upper flat surface 98 of upper retaining plate 1. When cylinder holder plate 4 is secured to adjusting ring 2 by cylinder holder plate locking screws 15, adjusting ring 2 is held in a rotatably sliding fit within upper retaining plate 1. Cylinder 29 of crimping means 66 is threadably inserted into adjusting ring 2 by rotating cylinder 29 in the direction of arrow 99 while holding adjusting ring 2 in stationary position or by holding cylinder 29 in stationary position and rotating adjusting ring 2 in a direction opposite arrow 99. Rotation of adjusting ring 2 is accomplished by inserting handle 9 into one of a plurality of holes 21 disposed in the lower portion of adjusting ring 2, moving handle 9 and adjusting ring 2 in the direction of arrow 99 or opposite thereof, repositioning handle 9 into a subsequent hole 21 and again rotating in or opposite arrow 99. Repeated steps described above will cause an upward or downward movement to crimping means 66 providing the desired presetting features of the present invention. Calibration ring 27 is disposed atop and concentric said crimping means 66 and adjusting ring 2. Calibration ring 27 has first scale 24 disposed on the outer annular surface thereof.

Figure 6:
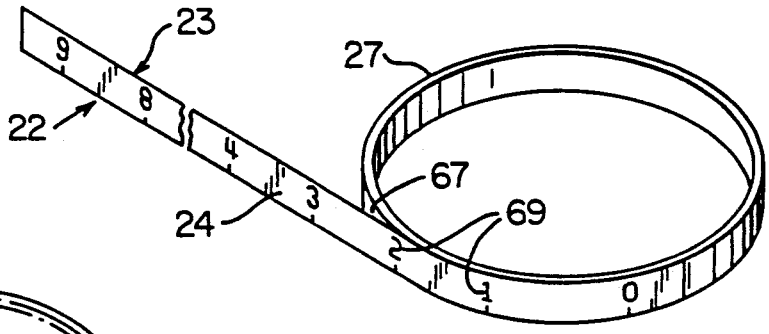
FIG. 6 shows a scale menas disposed on the outer surface of the adjusting ring means of FIG. 5.

Referring now to FIG. 6, first scale 24 is thin strip of material 22 which has adhesive back 23 on the surface opposite first scale 24 and is disposed about calibration ring 27 by wrapping first scale 24 about the outer annular surface of calibration ring 27. First scale 24 is provided with regularly spaced divisions 69 and is of sufficient length to exactly wrap outer annular surface 67 of calibration ring 27. Divisions 69 provide a precise angular scale on calibration ring 27 which is also rotatably secured to cylinder holder plate 4 and adjusting ring 2 by cylinder holder plate locking screws 15.

Figure 2:
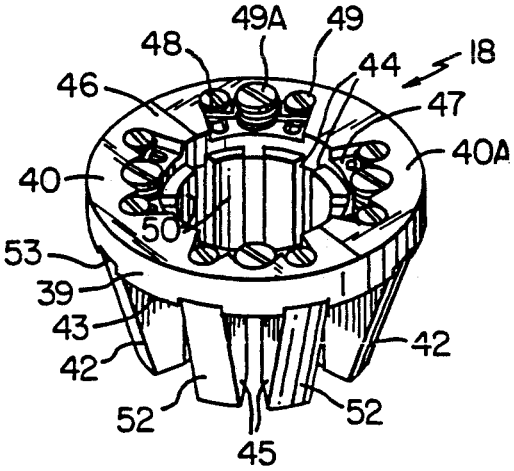
FIG. 2 is a view of one die assembly of a set of die assemblies used in the invention.

Reference is now made to FIG. 2 of the drawings which illustrates one embodiment of crimping die assembly 18 which is used with device 90 for crimping a workpiece such as coupling 41 (see FIG. 10 and FIG. 11). Die assembly 18 comprises die fingers 42 having an inside or crimping surface 50, an outside or conical bowl engaging surface 52, wedge-shaped side surfaces 44 and parallel side surfaces 45. Die fingers 42 are held together in die assembly 18 by means of a retainer ring 40 which comprises retainer ring halves 40 and 40A. (As used herein, number 40 will be used to represent both retainer ring halves 40 and 40A of retainer ring 40 unless otherwise noted.) Retainer ring 40 has a generally circular outside surface 39, a bottom surface 43 which has notches 53 for receiving die fingers 42, and top surface 46 which has recesses 47 in which are integrally received springing means 48 and fastening means, said fastening means comprising flat head cap screws 49 and 49A. A complete description of die assembly 18 may be obtained from aforementioned U.S. Pat. Nos. 4,707,648 and 4,625,539 issued to Brooks, et al and the entire disclosures of these two patents are incorporated herein by reference thereto.

Crimping means 66 comprises a fluid actuated cylinder 29 such as a hydraulic cylinder with piston 82 which projects from open end 83 of cylinder 29 and has an internal return spring (not shown) disposed adjacent outer annular surface 84 of piston 82. Cylinder 29 has internal stop means 63 which engages internal surface 64 of bottom plate 65 of cylinder 29 when fluid force causes piston 82 to move axially downward to it's fullest stroke. Cylinder 29 has threaded lower portion 85 adapted to be threadably engaged within threads 16 of adjusting ring 2. Piston 82 has attachment means 86 comprising an annular surface 87 with flat lower surface 88 for engaging upper surface 36 of pusher 11. Locking means (not shown) is disposed in axial alignment with piston 82 and pusher 11 and secures pusher 11 to flat lower surface 88 of piston 82. Cylinder 29 is attached by supply hose coupling 54 and hose 55 to a fluid supply source (not shown) such as a hydraulic pump (not shown) and is supplied with fluid under pressure through hose 55.

Pusher 11 has open face 37 directed toward the front of device 90. Open face 37 is an opening to cavity 38 of pusher 11 which is used to accept couplings which have a curved or elongated end. Cavity 38 is also used to provide sufficient space for the threaded end of coupling 41 to prevent damage thereto. Pusher 11 has lower flat cup shaped face 89 adapted to engage flat pusher plate 10 on upper surface 56 thereof. Lower surface 57 of pusher plate 10 in turn engages top surface 46 of die assembly 18. Retaining pins 6 provide support to circular outer surface 58 of pusher plate 10 to keep pusher plate 10 in direct axial alignment with die assembly 18 and pusher 11.

During the operation of crimping coupling 41 as shown disposed concentric axis 70 of device 90 of FIG. 10, selection of proper die assembly 18 and the proper setting of the predetermined relationship between die assembly 18 and crimping means 66 is first obtained by reference to a chart as shown in Table 1 below. Table 1 is a representative page from a booklet of crimping specifications supplied with device 90.

| | | | CRIMP SPECIFICATIONS | | | | |
|---|---|---|---|---|---|---|---|
| HOSE | CPLG. | SKIVE LENGTH | CRIMP LENGTH | DIE (COLOR) | CRIMP O.D. | APPROX. SETTING | ACTUAL SETTING |
| 4BX | SB | — | 1.00 | .520 (RED) | .675 | 74 | |
| 6BX | SB | — | 1.08 | .670 (YELLOW) | .790 | 79 | |
| 8BX | SB | — | 1.60 | .830 (BLUE) | .940 | 83 | |
| 10BX | SB | — | 1.315 | .830 (BLUE) | 1.070 | 58 | |
| 12BX | SB | — | 1.55 | 1.100 (GREEN) | 1.200 | 87 | |
| 16BX | SB | — | 1.75 | 1.320 (BLACK) | 1.540 | 68 | |
| 16BX | SC | — | 1.75 | 1.320 (BLACK) | 1.540 | 68 | |
| 20BX | SBA | — | 2.125 | 1.730 (SILVER) | 1.900 | 78 | |
| 12C | SH | — | FULL | 1.100 (GREEN) | 1.325 | 62 | |
| 6CE | SL | 1.05 | .960 | .830 (BLUE) | .865 | 96 | |

For instance, for the crimping of a 4BX coupling, die assembly 18, marked red, found under the heading "DIE (COLOR)" and the presetting numeral (74) listed under the heading "APPROX. SETTING" of the chart shown in Table 1 is first selected. Handle 9 shown in FIG. 9, is inserted into hole 21 of adjusting ring 2 which is then threadably adjusted until indicia 68 of second scale 28 indicates the first digit (7) of the presetting selected and further adjusting ring 2 is threadably adjusted with handle 9 until the second digit (4) of presetting numeral (74) is indicated by division 69 on first scale 24 aligned with index button 31 disposed on upper retaining plate 1. Hose end 61 and coupling 41 to be crimped thereon are inserted through the bottom of conical bowl 20. Die assembly 18 is then placed within the confines of and concentric with conical bowl 20 and surrounding coupling 41.

Pusher plate 10 is then disposed concentric said coupling 41 and said die assembly 18 and atop said die assembly 18 with lower surface 57 of pusher plate 10 in intimate contact with top surface 46 of die assembly 18 and with circular outer surface 58 of pusher plate 10 resting against retaining pins 6. Annular hole 59 in pusher plate 10 surrounds coupling 41 providing a free passage for coupling 41. Crimping means 66 is caused by fluid motion from fluid pump (not shown) to move axially downward toward said coupling 41, said pusher plate 10 and die assembly 18 until lower flat cup shaped surface 89 of pusher 11 contacts upper surface 56 of pusher plate 10 causing die assembly 18 to move axially downward and die fingers 42 to move radially inward crimping coupling 41 in a radial direction, said cylinder 29 extending to it's fullest stroke such that coupling 41 is crimped to it's desired diameter in accordance with said preset relationship.

In a similar manner, crimping of a 6BX coupling requires that a different presetting numeral be indicated on first scale 24 and on second scale 28. For instance, the presetting numeral (79) for a 6BX coupling requires that second scale 28 be adjusted by rotating adjusting ring 2 with handle 9 until indicia 68 of second scale 28 indicates the first digit (7) and then further adjusted until the second digit (9) of presetting numeral (79) is indicated by division 69 on first scale 24. Cylinder 29 when extended to it's fullest stroke is thereby caused to crimp coupling 41 to a larger diameter since the relationship between base plate 3 and upper retaining plate 1 has been adjusted by the moving of crimping means 66 away from base plate 3 by threadably adjusting ring 2 to the settings indicated on second scale 28 and first scale 24.

During the crimping of multiple numbers of workpieces of various sizes, some wear and distortion to pusher plate 10 and die assembly 18 may occur due to the extreme force required to force die fingers 42 of die assembly 18 to move inwardly to cause crimping of coupling 41. Therefore, calibration of device 90 of FIG. 1 is provided herein.

Calibration of device 90 of FIG. 1 is effected utilizing adjusting ring 2, first scale 24 and second scale 28. Referring again to FIG. 3, die assembly 18 and pusher plate 10 are first fully seated into conical bowl 20 of base plate 3.

First scale 24 and second scale 28 are adjusted to a presetting numeral of (86) in the manner described above for crimping a coupling. Presetting (86) is less than the maximum setting of 100 to prevent damage to pusher plate 10 and die assembly 18 when cylinder 29 is caused to move axially downward to it's fullest stroke length toward pusher plate 10. Crimping means 66 is caused to move axially downward toward pusher plate 10 by pump means (not shown). Pump means is actuated until cylinder 29 is extended to it's fullest stroke. A small gap 51 between lower flat cup shaped surface 89 of pusher 11 and upper surface 56 of pusher plate 10 should remain. By maintaining pump means at full pressure and therefore cylinder 29 at full stroke, adjusting ring 2 is rotated in a direction opposite to arrow 99 to cause axial movement of crimping means 66 downward until a setting of 100 is indicated by first scale 24 and second scale 28 when die assembly 18 is firmly seated into conical bowl 20 of base plate 3. If a setting of 100 cannot be achieved with cylinder 29 fully extended, lock nut 17 disposed concentric calibrating screw 8 is loosened and a screwdriver (not shown) is inserted into slot 62. The screwdriver rotates calibrating screw 8 until indicia 68 indicates the uppermost numeral (10) on second scale 28. Lock nut 17 is then secured. Cylinder holder plate locking screws 15 are then loosened and calibration ring 27 is rotated without rotating adjusting ring 2 such that the numeral (0) is indicated by division 69 on first scale 24 by index button 31. Cylinder holder plate locking screws 15 are then secured causing calibration ring 27 to be fully locked onto cylinder holder plate 4 and rotatably affixed thereunto. Pump means (not shown) is then turned off causing crimping means 66 to retract in an axially upward direction until cylinder 29 is fully retracted. Crimping device 90 of FIG. 1 is now calibrated and ready for further service.

Those skilled in the art will also appreciate that cylinder 29 of device 90 may require replacing after long and repeated crimping of workpieces such as coupling 41 due the extreme forces described above. Provision is provided herein to readily replace cylinder 29 such that device 90 of FIG. 1 may be quickly returned to service. Referring again to FIG. 3, one skilled in the art can quickly determine that by removing block holding screw 19 and moving block 7 axially upward away from crimping means 66 that block 7 may be removed from the top of crimping means 66. Further, it is apparent that by removing hose 55 by unscrewing supply hose coupling 54 from cylinder 29 that cylinder 29 may be readily removed from adjusting ring 2 by rotating cylinder 29 in a manner such that it moves axially upwardly from adjusting ring 2. New cylinder 29A (not shown) is then threaded into adjusting ring 2 in a manner opposite to the removing step described above. It is apparent that hose 55 must also be secured by supply hose coupling 54 to new cylinder 29 and that block 7 must be disposed about calibrating screw 8 and attached to crimping means 66 in the manner described above. Device 90 of FIG. 3 is then ready to be placed into service to crimp additional workpieces such as coupling 41.

Figure 7:
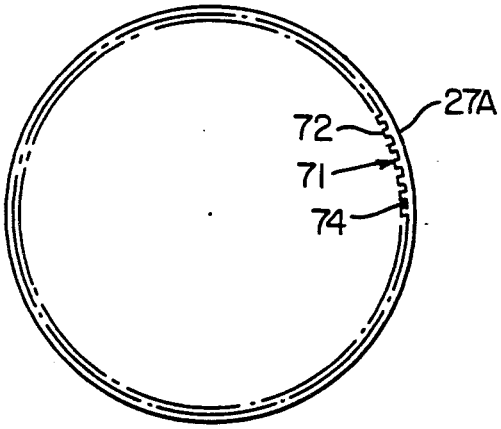
FIG. 7 is a view of annular ring means of FIG. 5 showing toothed means on the inside periphery thereof.
Figure 8:
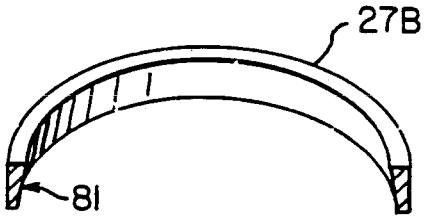
FIG. 8 is a view of annular ring means of FIG. 5 showing a tapered means on the inside surface thereof.

Alternate calibration rings 27A and 27B are shown in FIG. 7 and FIG. 8. Calibration ring 27A of FIG. 7 has toothed means 71. Toothed means 71 comprises alternating crests 72 and valleys 74 spaced in regular uninterrupted fashion about the inside surface of calibration ring 27A of FIG. 7. Cooperating cylinder holder plate 4A (not shown) with toothed outer periphery is also provided. One hundred sets of alternating crests 72 and valleys 74 provide precise adjustment means for calibration ring 27A. In similar fashion, calibration ring 27B of FIG. 8 is provided with tapered surface 81 and similarily cooperating tapered surface of cylinder holder plate 4B (not shown) is provided such that calibration ring 27B can be lifted and moved circumferentially about holder plate 4B for easy calibration. Calibration ring 27B can then be placed at any position on the outer surface of holder plate 4B (not shown) providing again precise adjustment means of calibration ring 27B.

One skilled in the art will appreciate that index button 31 could be replaced by calibrating screw 8 with lock nut 17 disposed about calibrating screw 8 such that calibrating screw 8 is utilized as index button 31. Additionally, block 7 would be disposed about the upper portion of calibrating screw 8 in a manner similar to that shown in FIG. 5 with the exception that calibrating screw 8 and block 7 are located at the position shown for index button 31 in FIG. 1.

Device 90 can be transported readily by grasping strain rod 33 or 12 and removing the device 90 from the table. Since only a hand pump (not shown) can be used to provide fluid pressure to crimping means 66, the need to carry an electric pump and provide electrical power is obviated.

Support legs 30 and 34 are generally positioned such that axis 70 of device 90 overlies the edge of the table upon which device 90 has been placed. A long length of hose with hose end 61 can then be inserted into die assembly 18 from the bottom of device 90 and crimping of coupling 41 can be easily effected. Since device 90 rests on the table surface and support legs 30 and 34 frictionally engage the table surface, sufficient resisting torque is provided when adjusting ring 2 is rotated to the proper position for crimping of coupling 41.

Those skilled in the art will appreciate that various other configurations of calibrating screw 8 and block 7 as well as division 69 and indicia 68 may be provided without departing from the scope of the invention.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a device for crimping a coupling to an end of a hose, said device comprising support means, die means carried by said support means for holding said hose end and said coupling, and crimping means carried by said support means and spaced apart from said die means a certain distance and in axial alignment therewith and comprising a cylinder member having a stop means and a piston member carried by said cylinder member adapted to be moved axially relative to said cylinder member into engagement with said die means to axially move said die means therewith until a part of said piston member abuts said stop means, said crimping means further including a chamber established between said piston member and cylinder member so that pressurizing said chamber produces relative movement between the piston member and cylinder member, the improvement comprising adjusting means movably carried by said support means and being operatively interconnected to said cylinder member of said crimping means for adjusting the entire axial position of said crimping means relative to said adjusting means and to said die means as said adjusting means is moved relative to said support means so as to change said certain distance to a new certain distance whereby when said piston member of said crimping means is moved into engagement with said stop means said coupling is crimped to said hose end by said die means in accordance with a predetermined relationship that is determined by said new certain distance.

2. A device as set forth in claim 1 wherein said adjusting means comprises a calibration ring means.

3. A device as set forth in claim 2 wherein said calibration ring means has an outer periphery, and a first scale means disposed on said outer periphery of said ring means.

4. A device as set forth in claim 3 wherein said first scale means comprises an adhesive backed tape means disposed on said outer periphery of said ring means.

5. A device as set forth in claim 2 wherein said adjusting means has an outer periphery, said calibration ring means being of precise inside diameter which is removably slip fitted about said outer periphery of said adjusting means.

6. A device as set forth in claim 3 wherein said first scale means is inscribed onto said outer periphery of said ring means.

7. A device as set forth in claim 3 wherein said first scale means is embossed onto said outer periphery of said ring means.

8. A device as set forth in claim 1 wherein said adjusting means comprises a calibration means disposed in linear relationship with said cylinder member and said support means.

9. A device as set forth in claim 8 wherein said calibration means comprises block means attached to said cylinder member and adjustable index means attached to said support means.

10. A device as set forth in claim 9 wherein said adjustable index means is threadably interconnected to said support means.

11. A device as set forth in claim 9 wherein said block means has an outer surface, and a scale means disposed onto said outer surface.

12. A device as set forth in claim 11 wherein said scale means is inscribed onto said outer surface of said block means.

13. A device as set forth in claim 11 wherein said second scale means comprises adhesive backed tape means.

14. A device as set forth in claim 11 wherein said scale means is embossed onto said outer surface of said block means.

* * * * *